US011241636B2

(12) United States Patent
Vetuskey et al.

(10) Patent No.: US 11,241,636 B2
(45) Date of Patent: Feb. 8, 2022

(54) TOY VEHICLE HAVING ADJUSTABLE SUSPENSION

(71) Applicant: Mattel, Inc., El Segundo, CA (US)

(72) Inventors: Brendon Vetuskey, Long Beach, CA (US); James A. Molina, Westminster, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 17/061,645

(22) Filed: Oct. 2, 2020

(65) Prior Publication Data

US 2021/0101085 A1 Apr. 8, 2021

Related U.S. Application Data

(60) Provisional application No. 62/909,927, filed on Oct. 3, 2019.

(51) Int. Cl.
*A63H 17/26* (2006.01)

(52) U.S. Cl.
CPC ..... *A63H 17/262* (2013.01)

(58) Field of Classification Search
CPC ..... A63H 17/262
USPC ..... 446/466; 280/86.5
See application file for complete search history.

(56) References Cited

U.S. PATENT DOCUMENTS 1,851,655 A * 3/1932 Vincent ..... B60G 7/001 267/183
3,063,194 A 11/1962 Berguerand
3,510,981 A 5/1970 Branche
3,720,017 A 3/1973 Ersilio
4,159,126 A 6/1979 Raleigh
4,602,800 A * 7/1986 Persson ..... B60G 17/04 280/6.156
4,696,655 A 9/1987 D'Andrade
4,822,316 A * 4/1989 Shaffer ..... A63H 17/262 446/466
4,846,756 A 7/1989 Hesse
5,306,038 A * 4/1994 Henderson, Jr. ..... A63H 17/262 446/466

(Continued)

FOREIGN PATENT DOCUMENTS

CN 203507527 U * 4/2014 ..... A63H 17/26
CN 208865174 U * 5/2019 ..... A63H 17/26

OTHER PUBLICATIONS

Chen. CN208865174 Machine Translation, uploaded Jun. 25, 2021, Espacenet, 3 pages.*

(Continued)

*Primary Examiner* — Eugene L Kim
*Assistant Examiner* — Matthew B Stanczak
(74) *Attorney, Agent, or Firm* — Edell, Shapiro & Finnan, LLC

(57) ABSTRACT

A toy vehicle includes at least a chassis, a front wheel base, and a suspension system. The suspension system adjustably secures the front wheel base to the chassis in a manner that provides two operational modes. In a first mode of the two operational modes, the front wheel base is freely, resiliently supported below the chassis. In a second mode of the two operational modes, the front wheel base is selectively posable by a user over a range of orientations for different types of vehicle mobility. The suspension system retains poses when the toy vehicle is operating in the second mode.

16 Claims, 18 Drawing Sheets

(56) References Cited

U.S. PATENT DOCUMENTS 5,527,059 A * 6/1996 Lee, Jr. ..... A63H 17/004 280/43.23
5,700,026 A * 12/1997 Zalewski ..... B60G 17/017 280/6.151
6,293,562 B1 * 9/2001 Kutscher ..... B60G 17/016 280/6.159
6,419,547 B1 7/2002 Hartelius
6,478,655 B2 11/2002 Wu
6,589,098 B2 7/2003 Lee
6,599,169 B2 7/2003 Edmisson
6,764,376 B2 * 7/2004 Agostini ..... A63H 17/26 446/466
6,767,272 B2 * 7/2004 Santarsiero ..... A63H 17/004 446/437
6,793,555 B1 * 9/2004 Tilbor ..... A63H 17/004 446/456
7,237,779 B2 * 7/2007 Kondo ..... B60G 17/00 280/6.157
7,261,615 B2 8/2007 Hoeting
7,335,084 B2 2/2008 Sato
7,793,951 B2 9/2010 Byers
7,841,923 B2 * 11/2010 Marzetta ..... A63H 17/262 446/466
8,079,892 B2 * 12/2011 Wang ..... A63H 17/262 446/466
8,480,106 B1 7/2013 Cohen
8,646,566 B1 * 2/2014 Bouzit ..... B60K 17/24 180/376
9,096,261 B2 * 8/2015 Aldrich ..... B60G 9/02
9,333,436 B2 5/2016 Anthian
9,375,649 B2 * 6/2016 Colquhoun ..... A63H 17/262
9,950,268 B2 4/2018 Fie, II
10,293,875 B2 * 5/2019 Roberson ..... B62D 61/125
10,413,838 B2 * 9/2019 Chu ..... A63H 17/262
2003/0003843 A1 * 1/2003 Edmisson ..... A63H 17/262 446/466
2009/0124166 A1 * 5/2009 Marzetta ..... A63H 17/262 446/289
2011/0028068 A1 * 2/2011 Wang ..... A63H 33/005 446/436
2012/0208429 A1 8/2012 Sheridan
2013/0309938 A1 * 11/2013 Houlahan ..... A63H 17/262 446/466
2014/0306415 A1 * 10/2014 Aldrich ..... B60G 9/022 280/124.116
2018/0078867 A1 3/2018 Ferreyra
2018/0185761 A1 7/2018 Webster
2019/0022540 A1 * 1/2019 Chu ..... A63H 17/264
2019/0193500 A1 6/2019 Abramov
2021/0101085 A1 * 4/2021 Vetuskey ..... A63H 17/262

OTHER PUBLICATIONS

Chen. CN203507527 Machine Translation, uploaded Jun. 25, 2021, Espacenet, 3 pages.*

* cited by examiner

TOY VEHICLE HAVING ADJUSTABLE SUSPENSION

CROSS REFERENCE TO RELATED APPLICATIONS

This application claims priority to and is based on U.S. Patent Application No. 62/909,927, filed Oct. 3, 2019, entitled "Toy Vehicle Having Adjustable Suspension," the entire disclosure of which is incorporated herein by reference.

FIELD OF THE INVENTION

The present invention relates to toy vehicles and, more specifically, to a preferably die-cast toy vehicle having a simple suspension adjustment that permits the vehicle body to be selectively positioned in a range of interesting orientations relative to the vehicle wheels.

BACKGROUND OF THE INVENTION

Toy vehicles, which generally comprise miniaturized versions of full-size vehicles, either real or fanciful, have proven to be an extremely popular type of toy among children for many years. This popularity has been enhanced by a virtually endless variety of toy vehicle shapes, sizes and configurations. Perhaps one of the most interesting developments in such toy vehicles is the creation of toy vehicles having the ability to be changed or altered in their appearance and types of motion when played with by the user. This development has provided increased amusement and enjoyment in many instances but there remains a continuing need for even more varied and interesting reconfigurable toy vehicles.

SUMMARY OF THE INVENTION

The present application provides a toy vehicle chassis that can be supported in different orientations relative to the vehicle wheels, such that the vehicle appearance and type of movability can be readily adjusted. That is, the toy vehicle system embodiments disclosed herein have a suspension system that can adjustably secure front and rear wheel bases to a vehicle chassis in two operational modes: a first mode; and a second mode. In the first mode, the vehicle chassis is freely, resiliently supported in a position above the wheel bases. In the second mode, the suspension system is stiff (i.e., non-resilient) and the wheel base axles can be selectively independently movable by a user over a range of orientations. This permits the vehicle to assume and remain in selected positions, each position providing for a respective different type of vehicle mobility.

In one embodiment, the wheel base includes independently movable, longitudinally spaced front and rear axles that extend transversely with respect to the toy vehicle and have wheels rotatably mounted at their ends. The two axles are mounted so as to be movable independently of one another relative to the vehicle chassis. The suspension system includes four coiled compression springs each concentrically surrounding a respective shock rod having an upper end secured to the vehicle chassis and a lower end secured to the axle proximate a respective wheel. Front and rear mounting blocks are rigidly secured to the front and rear axles, respectively, proximate the longitudinal center of the axle. Each mounting block receives, in a rigid connection, a proximal end of a respective adjustment rod that extends from the mounting block upwardly and longitudinally of the chassis, toward a transfer case. The transfer case has a base plate fixedly secured to the underside of the chassis proximate the chassis center, and a cover plate that can be selectively tightened against, or loosened to be spaced from, the base plate. The distal end of each adjustment rod terminates in a diametrically smaller neck section supporting a larger ball member disposed in the transfer case. In the first operational mode, the transfer case cover is loosely suspended slightly spaced from the base plate and the ball member is loosely contained in the transfer case. This permits the springs and shock bars to control the position of the chassis relative to the wheel base. In the second operational mode, the transfer case cover is tightly urged against the baseplate, constraining the ball member and frictionally preventing inadvertent rotation of the ball member and adjustment rod about the rod axis. In this mode, a user can grasp and forcefully rotate the front and rear wheel pairs about multiple axes in opposition to the frictional engagement of the ball member in the transfer case, and when the turning force is removed the thusly rotated wheel pair is held in its last position by that frictional engagement.

A normalizing assembly is provided to prevent unlimited and inadvertent rotation of an axle and its associated wheel base about its adjustment rod axis. In one embodiment, the normalizing assembly comprises a pair of trailing arms or rods for each axle, one on each side of the adjustment rod, extending parallel to the adjustment rod from the axle into the transfer case. The trailing arm mounting is provided with freedom of longitudinal motion, either in the transfer case or at the axle, or both. Thus, if the user positionally adjusts the wheel assembly in the second operational mode, the trailer rods can resiliently bend slightly and slide longitudinally to oppose, but not prevent, rotation of the axle about the adjustment rod axis. In another embodiment, the trailing arms are replaced with two torsion springs having respective center coils secured at respective sides of the transfer case and arms slidably extending through respective axles.

DETAILED DESCRIPTION OF THE EMBODIMENTS

Figure 1:
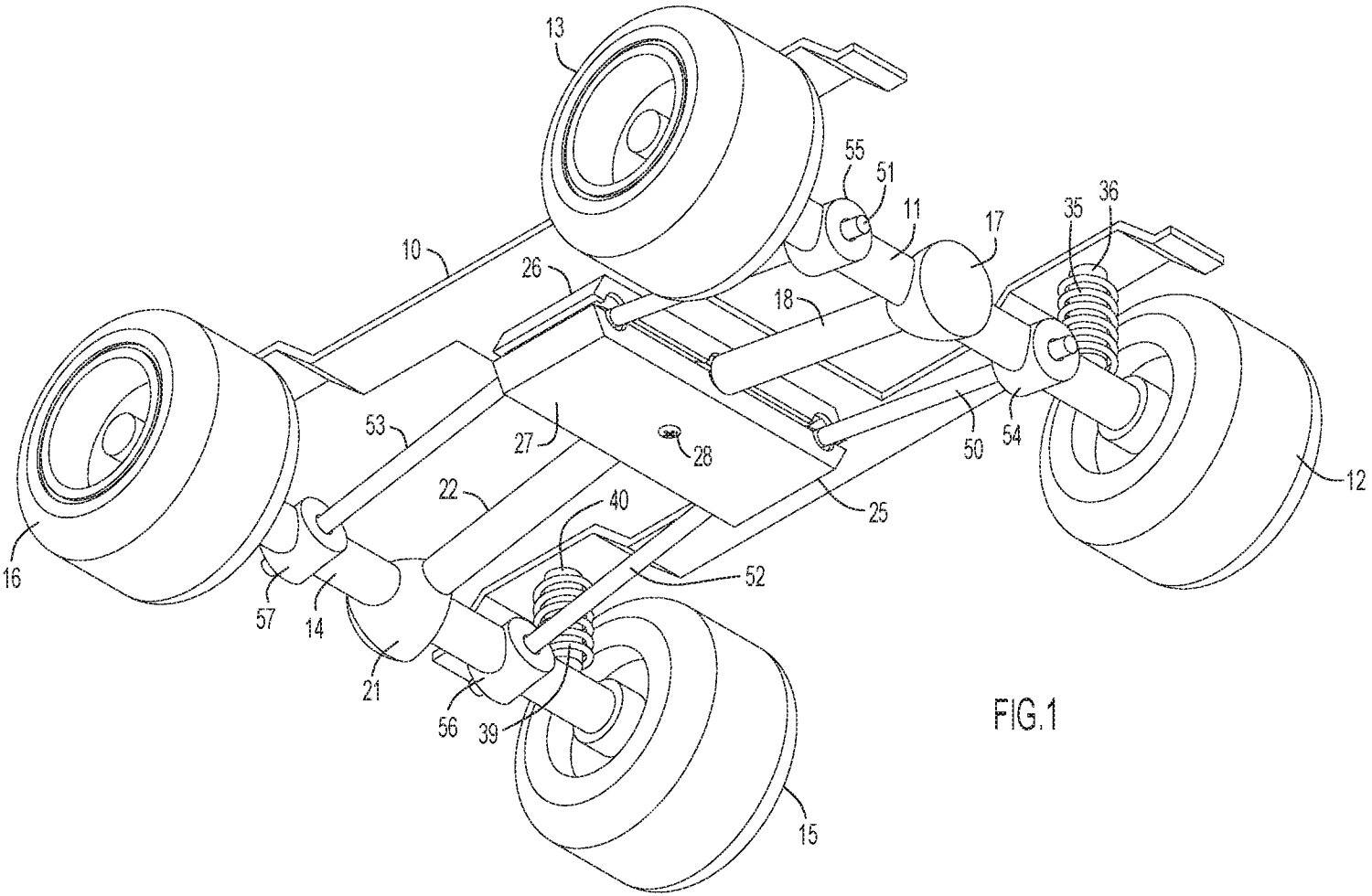
FIG. 1 is a bottom view in perspective of a first embodiment of a toy vehicle chassis, wheels and suspension system shown in its first operational mode with the compression system springs compressed.

The embodiments disclosed herein comprise a novel method and apparatus for securing the chassis of a miniature toy vehicle to the vehicle axles and suspension spring to permit the orientations of the axles to be independently adjusted relative to the vehicle chassis so that the vehicle appearance and types of motion can be easily changed by a user.

Referring to FIGS. 1-13, a first embodiment comprises a vehicle chassis 10, and front and rear wheel base assemblies. It will be understood that a vehicle body would typically be secured to and above the chassis but is not shown because the body affects only the appearance of the vehicle and has no relevance to the functions and operations described herein. The front wheel base assembly includes a front axle 11 and left and right front wheels 12 and 13 rotatably secured to respective axle ends. The rear wheel base assembly includes a rear axle 14 and left and right rear wheels 15, 16 rotatably secured to respective axle ends. A front mounting block 17 is fixedly secured to front axle 11 proximate the longitudinal center of the axle (i.e., corresponding to the transverse center of chassis 10). A rear mounting block 21 is fixedly secured to rear axle 14 proximate the longitudinal center of the axle (i.e., again, corresponding to the transverse center of chassis 10). Axles 11 and 14 may each take the form of a single member extending through respective mounting blocks 17 and 21. Alternatively, the axles may each comprise two coaxially aligned members, each extending from its associated mounting block to a respective wheel. In one embodiment each axle is a hollow tube for reasons described herein.

Front mounting block 17 receives the proximal end of front adjustment rod 18 in a rigid or fixed connection such that the rod extends from the mounting block upwardly and rearwardly into a transfer case 25 secured to the underside of chassis 10. Likewise, rear mounting block 17 receives in a rigid connection the proximal end of rear adjustment rod 22 such that rod 22 extends from the rear mounting block upwardly and forwardly into transfer case 25. Transfer case 25 includes a base plate 26 fixedly secured to the underside of chassis 10 proximate the chassis center, and a cover plate 27 adjustably secured to base plate 26 by an adjustment member 28, such as an adjustable screw, so that the cover plate that can be selectively tightened against, or loosened to be suspended spaced from, the base plate. Specifically, adjustment member 28 extends through cover plate 27 up and into a threaded socket defined in the underside of base plate 26 such that, in a first operational mode, the screw is retained in the socket but is backed off so that cover plate 27 is supported by screw 28 in slightly spaced relation to base plate 26. In a second operational mode, screw 28 is tightened to forcefully urge the edges of cover plate 27 against the edges of base plate 26.

Figure 11:
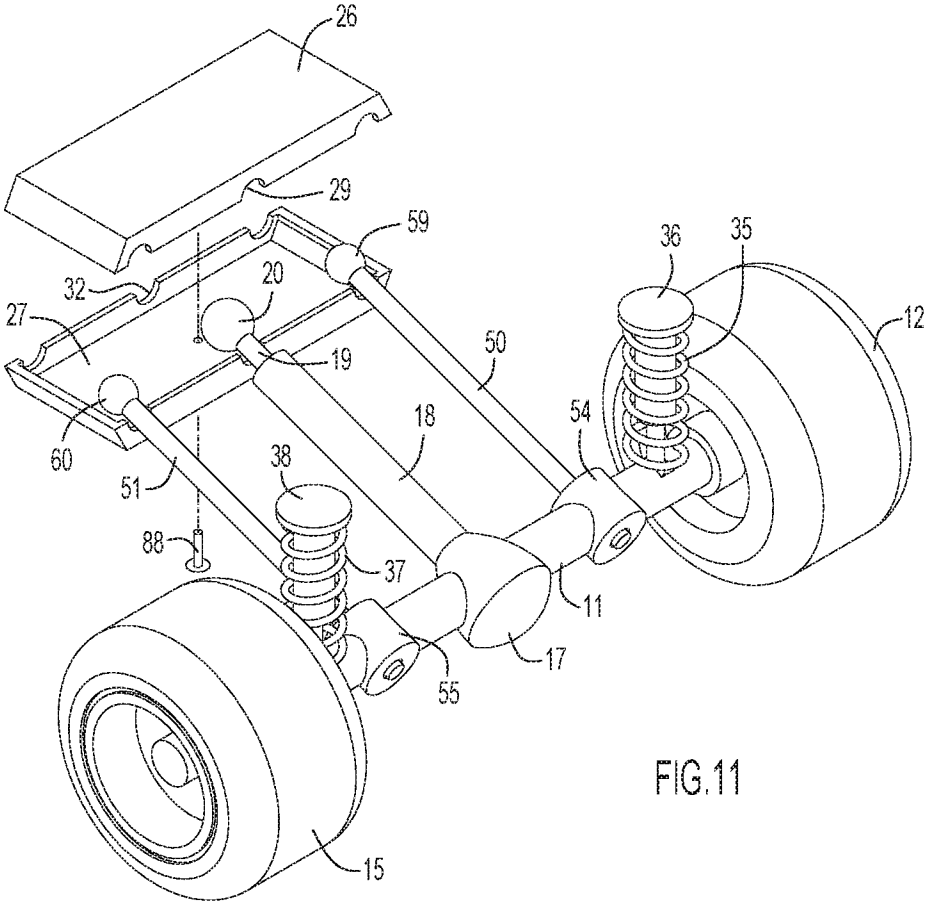
FIG. 11 is an exploded view in perspective of a transfer case and its structural relationship to the vehicle front wheel assembly in the first embodiment.
Figure 12:
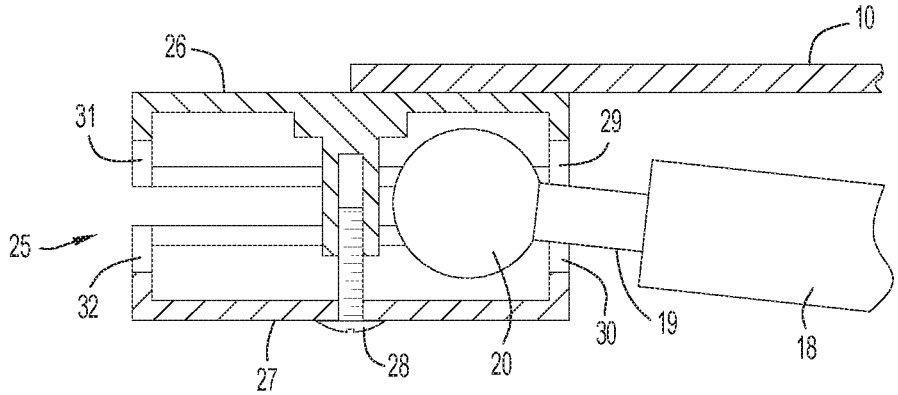
FIG. 12 is a cross-sectional view of the transfer case of FIG. 11 showing the transfer case cover loosely attached to the case base.
Figure 13:
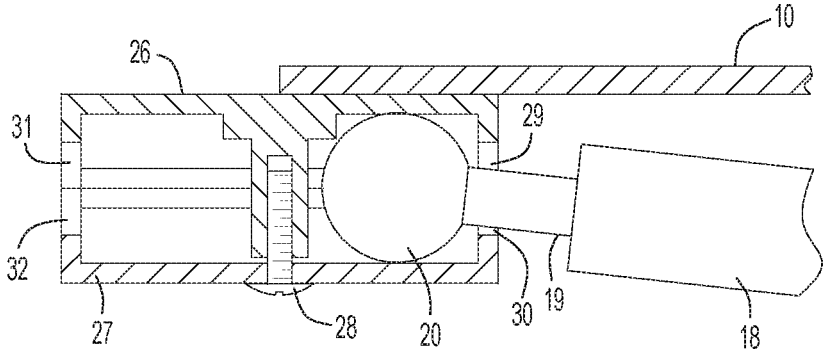
FIG. 13 is a cross-sectional view of the transfer case of FIG. 11 showing the transfer case cover tightly secured to the case base.
Figure 14:
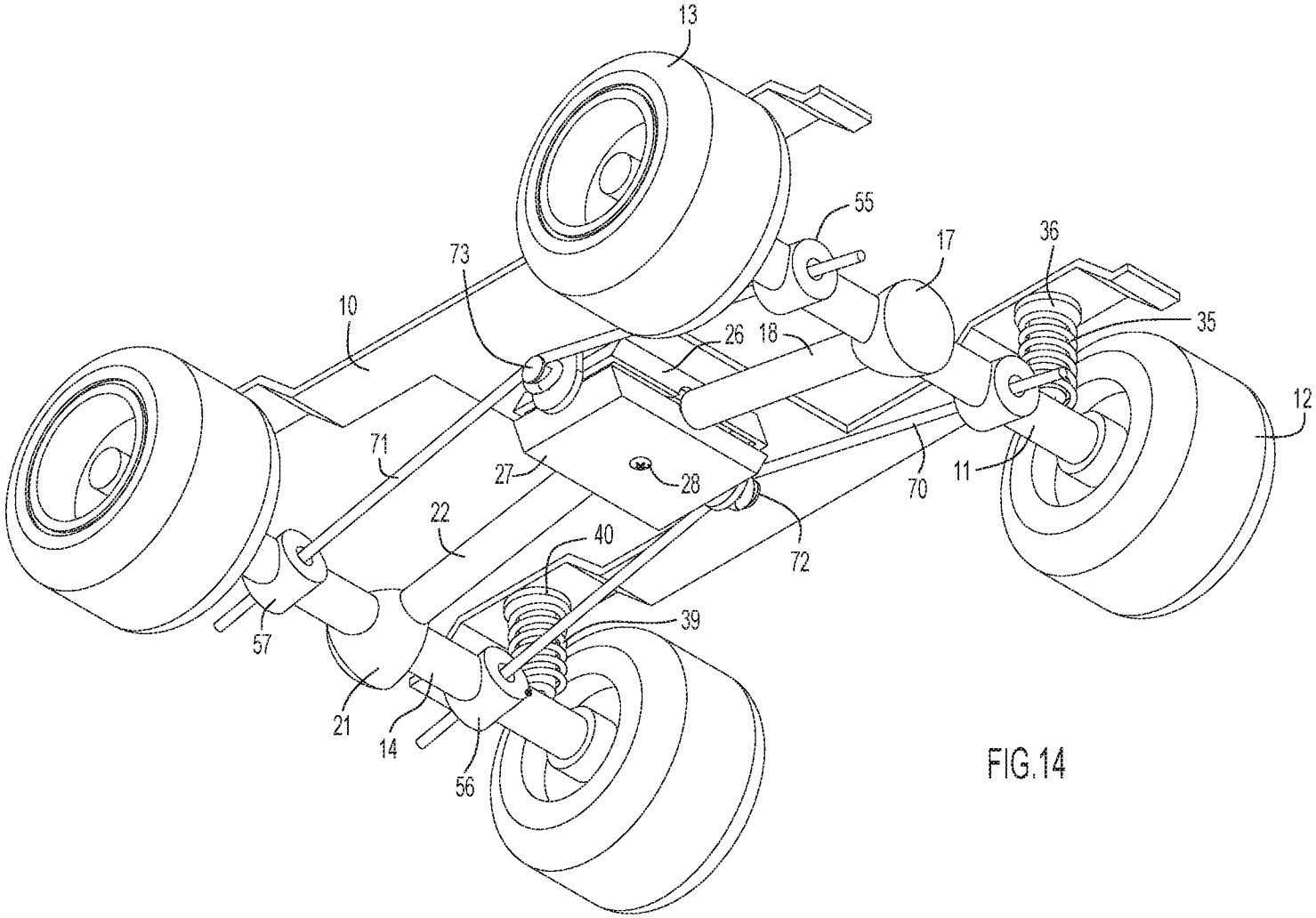
FIG. 14 is a bottom view in perspective of a second embodiment of a toy vehicle chassis, wheels and suspension system shown in its first operational mode with the compression system springs compressed.
Figure 15:
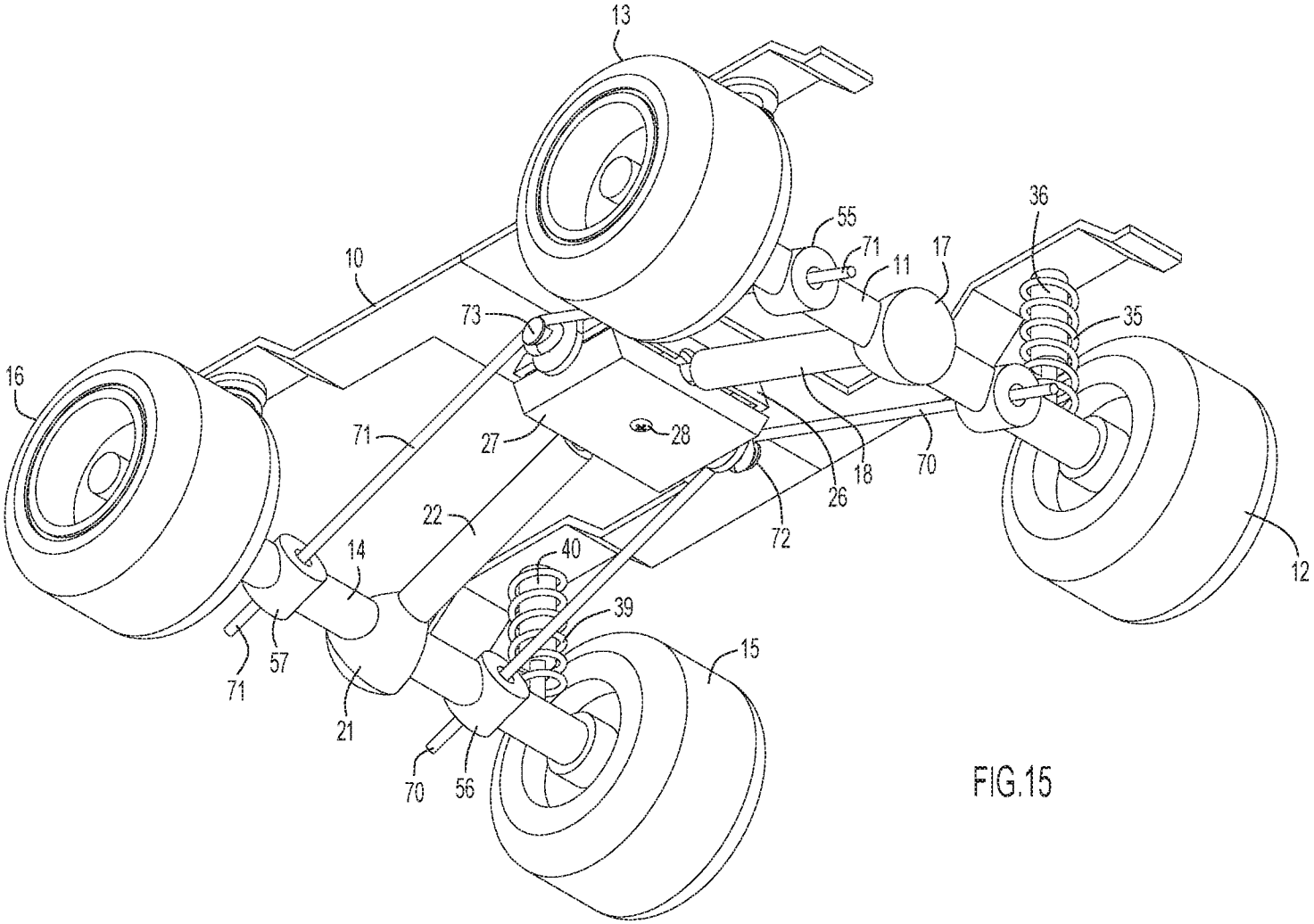
FIG. 15 is a bottom view in perspective of the second embodiment shown in its first operational mode with the suspension system springs uncompressed.
Figure 16:
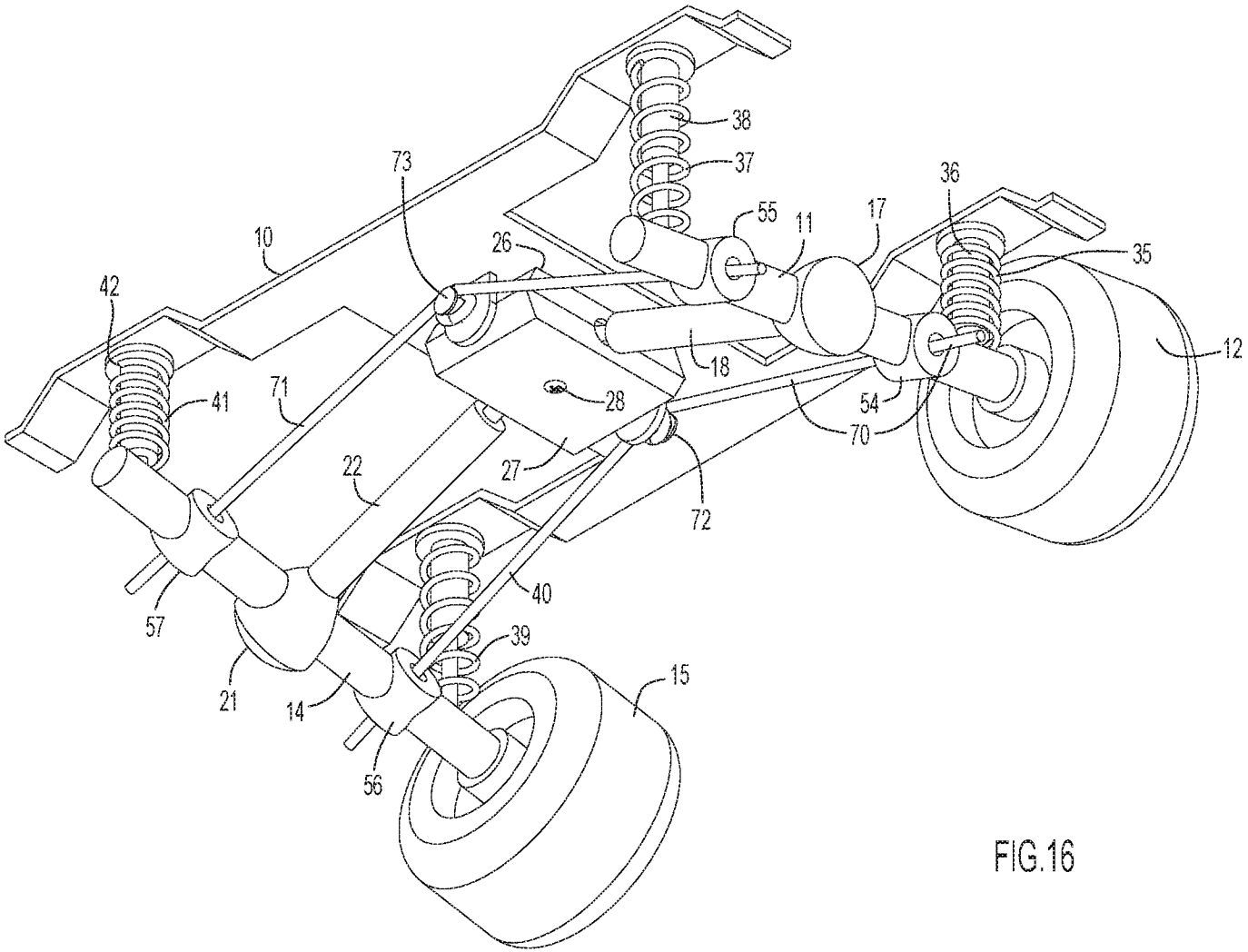
FIG. 16 is a bottom view in perspective the second embodiment shown in its second operational mode and wherein the wheels have been selectively repositioned.
Figure 17:
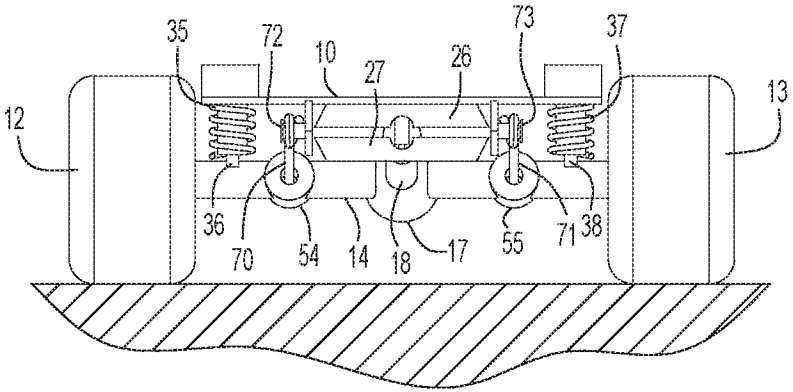
FIG. 17 is a partial view in vertical elevation of the second embodiment as illustrated in FIG. 14 shown with the vehicle wheels on the ground and the springs compressed.
Figure 18:
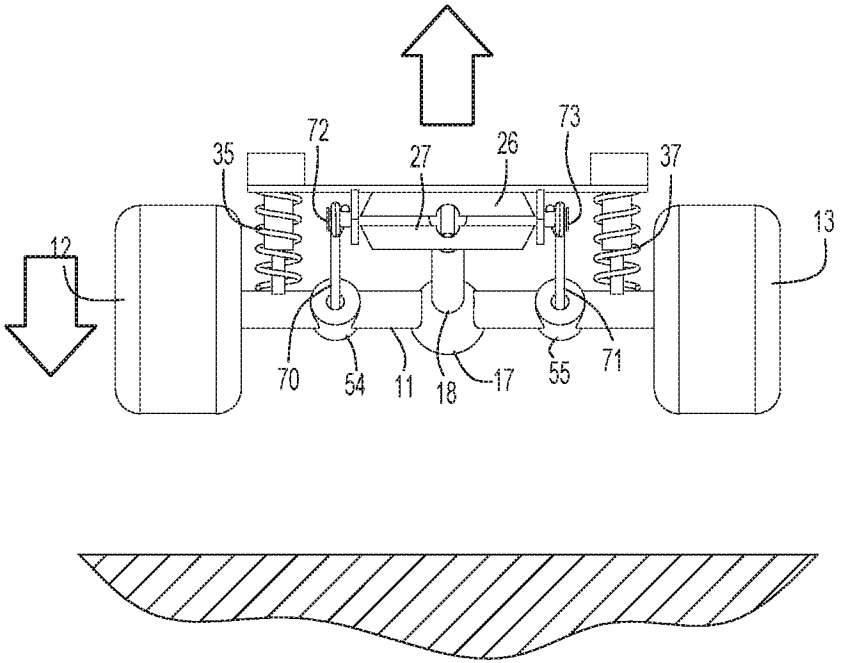
FIG. 18 is a partial view in vertical elevation of the second embodiment as illustrated in FIG. 17 but shown with the vehicle wheels off the ground and the springs uncompressed.
Figure 19:
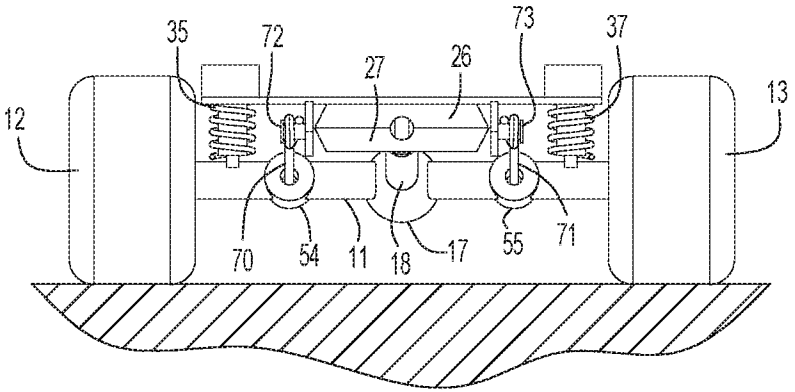
FIG. 19 is a partial view in vertical section of the second embodiment shown in its second operational mode with the vehicle wheels on the ground and the springs compressed.
Figure 20:
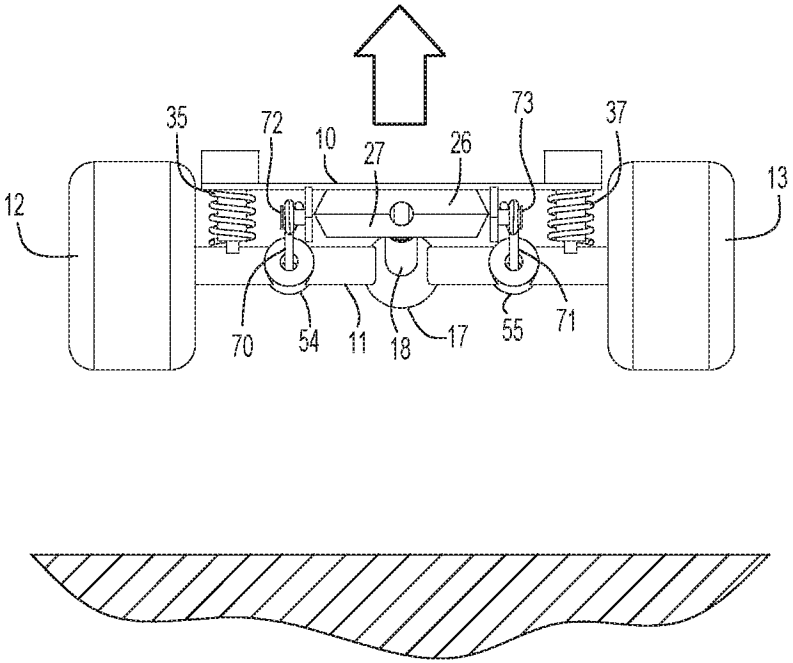
FIG. 20 is a partial view in vertical section of the second embodiment shown in the second operational mode with the vehicle wheels shown off the ground and the springs compressed.
Figure 21:
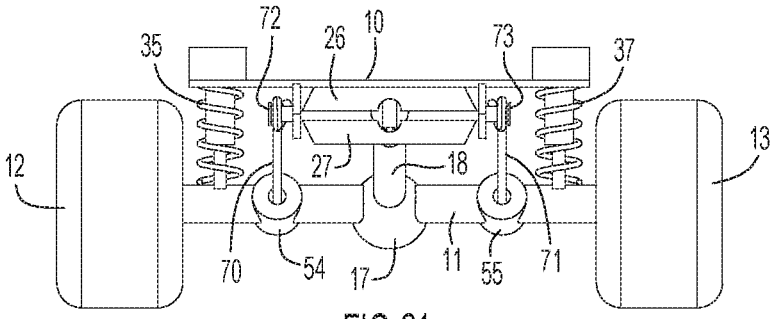
FIG. 21 is a partial view in vertical section of the second embodiment shown in the first operational mode with the springs extended.
Figure 22:
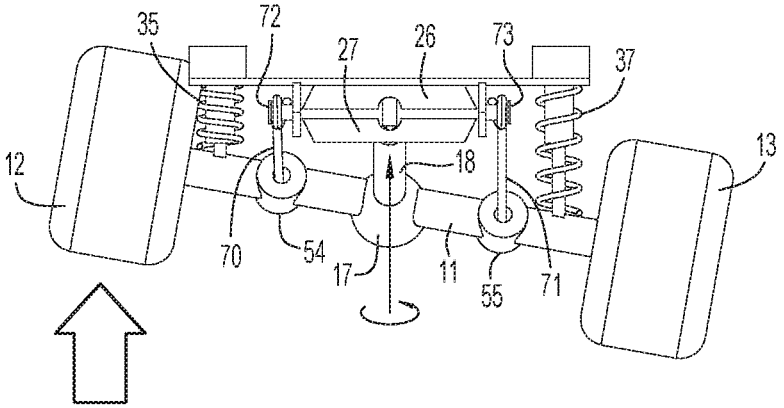
FIG. 22 is a partial view in vertical section of the second embodiment shown in the second operational mode with the wheel assembly diagrammatically shown being placed in a first articulated position.
Figure 23:
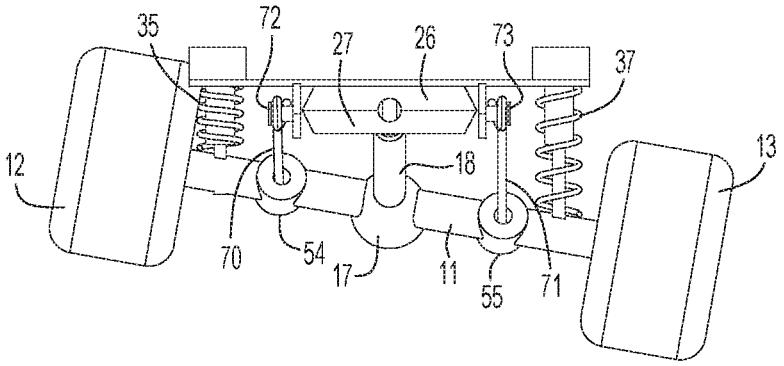
FIG. 23 is a partial view in vertical section of the second embodiment shown in the second operational mode with the wheel assembly shown stably remaining in the first articulated position.

As best seen in FIGS. 11-13, the distal end of front adjustment rod 18 terminates in a diametrically smaller neck section 19 supporting a ball member 20 extending therefrom and disposed in transfer case 25. Base plate 26 and cover plate 27 are preferably generally rectangular similar plates having bends or bevels proximate their edges so that the edges of the base plate abut facing edges of the cover plate in flush relation in the second operational mode when the plates are tightened together by adjustment member 28 in the closed position of the plates. A recess 29 is defined in the forward facing edge of base plate 26 at a location proximate the center of that plate edge. A similar recess 30 is defined in the forward facing edge of cover plate 27 such that recesses 29 and 30 are in vertical alignment and cooperatively surround the distal neck portion 19 of rod 18 with ball member 20 disposed in case 25 between the plates. Importantly, the diameter of ball member 20 is larger than the largest dimension formed by the opening between recesses 29 and 30 in both operational modes (i.e., in the spaced and abutting positions of the plates) so that the ball member 20 is always retained in transfer case 25. In the illustrated embodiment the recesses 29 and 30 are shown to be semicircular; however, it will be understood that the recesses can have any configuration consistent with the function described herein; alternatively, only one plate edge may be recessed and still provide the functions described herein.

Left and right front coiled compression springs 35 and 37 surround respective longitudinally compressible and expandable shock absorbers 36 and 38. Left and right rear coiled compression springs 39 and 41 surround respective longitudinally compressible and expandable shock absorbers 40 and 42. One end of each shock absorber 36, 38 is fixedly secured to front axle 11 at a location proximate a respective wheel 12, 13. The other end of each front shock absorber 36 and 38 is fixedly secured to chassis 10. One end of each rear shock absorber 40 and 42 is fixedly secured to rear axle 14 at a location proximate a respective wheel 15, 16. The other end of each shock absorber 40 and 42 is fixedly secured to chassis 10. This arrangement resiliently supports the chassis above the wheel bases.

As noted above, in the first operational mode of the vehicle the transfer case adjustment member 28 is loosely held in the threaded socket in base plate 26 and the cover plate 27 is spaced from the base plate 26. In this mode the ball member 20 is loosely contained in the transfer case, permitting the springs (e.g., springs 35 and 37 and/or springs 39 and 41) and shock absorbers (e.g., shock absorbers 36 and 38 and/or shock absorbers 40 and 42) to control the position of the chassis 10 relative to the front wheel base and/or back wheel base. That is, in the absence of externally applied forces, the chassis 10 is resiliently spaced above the wheel assemblies. If a downwardly directed force is applied to the chassis 10, the springs (e.g., springs 35 and 37 and/or springs 39 and 41) will be compressed and the spacing between the chassis 10 and wheel bases will be reduced. When that force is removed, the chassis 10 will be resiliently returned, by the springs (e.g., springs 35 and 37 and/or springs 39 and 41), back to, or at least towards, its original position.

In the second operational mode the transfer case cover plate 27 is tightly urged toward the base plate 26, constraining the ball member 20 against vertical movement and frictionally preventing inadvertent rotation of the ball member and the rod. In this mode, a user can grasp and forcefully rotate the front wheels 12, 13 about the rod axis (and other axes) in opposition to the frictional engagement of the ball member in the transfer case. When that turning force is removed, the thusly rotated front wheel pair and front axis are held in their last position by the frictional engagement of ball member 20 between the transfer case plates (base 26 and cover plate 27). That is, the frictional engagement of ball member 20 between the transfer case plates (base 26 and cover plate 27) may be strong enough to resist the resilient forces generated by springs 35 and 37 and/or shock absorbers 36 and 38 and can maintain the front wheel base in a "posed" position.

Although omitted from FIGS. 11-13 for purposes of clarity and understanding, the rear adjustment rod 22 may be provided with a similar distal ball member that is contained in transfer case 25 and frictionally engaged and released simultaneously with front ball member in the second and first operational modes. Thus, when the wheel assembly is in the second operational mode, a user can also grasp and forcefully rotate the rear wheels 15, 16 about the longitudinal axis of the rear adjustment rod 22 (and other axes), independently of the front wheels, in opposition to the frictional engagement of the rear ball member in the transfer case (base 26 and cover plate 27). When that turning force is removed, the thusly rotated rear axle and rear wheels are held in their last position by the frictional engagement of the rear ball member between the transfer case plates. That is, the frictional engagement of the rear ball member between the transfer case plates (base 26 and cover plate 27) may be strong enough to resist the resilient forces generated by springs 39 and 41 and/or shock absorbers 40 and 42 and can maintain the back wheel base in a "posed" position.

Still referring to FIGS. 1-13, the front axle 11 may be a hollow tube and may have left and right front collar members 54 and 55 supported thereon at locations between mounting block 17 and respective wheels 12 and 13. Each collar member is in the form of a hollow cylinder having a transverse through bore through which front axle 11 extends. Collar members 54, 55 serve to slidably support proximal ends of respective left and right front trailing arms 50, 51. In this regard, opposite ends of the collar members 54, 55 have axially aligned openings through which the proximal ends of the trailing arms 50, 51 slidably extend. The distal ends of trailing arms 50, 51 terminate in respective retainer members 59 and 60. Trailing arms 50, 51 extend into transfer case 25 through respective openings in the forward facing edge of the transfer case disposed on opposite sides of the central opening formed by recesses 29, 30. The distal ends of the trailing arms 50, 51 (and retainer members 59, 60) are thereby retained in the transfer case in both operational modes. The trailing arms, which are somewhat rigid but may be resiliently bendable, extend parallel to front adjustment rod 18 and to one another.

The rear axle 14 is likewise hollow and tubular and has left and right rear collar members 56 and 57 supported thereon at locations between mounting block 21 and respective wheels 15 and 16. Each collar member 56, 57 is also in the form of a hollow cylinder having a transverse through bore through which rear axle 14 extends. Collar members 56, 57 serve to slidably support proximal ends of respective left and right rear trailing arms 52, 53. In this regard, opposite ends of collar members 56, 57 have axially aligned openings through which the proximal ends of the trailing arms 52, 53 slidably extend. The distal ends of trailing arms 52, 53 terminate in respective retainer members 61 and 62. Trailing arms 52, 53 extend into transfer case 25 through respective openings in the rearward facing edge of the transfer case disposed on opposite sides of the central opening that receives rear adjustment rod 22 and is formed by recesses 31, 32. The distal ends of the trailing arms 52, 53 (and retainer members 61, 62) are thereby retained in the transfer case in both operational modes. The trailing arms, which are somewhat rigid but may be resiliently bendable, thus extend parallel to one another and to rear adjustment rod 22.

The trailing arms 50, 51, 52, 53 provide positional stability for the axles as well as prevent inadvertent rotation of each axle about its adjustment rod. Such inadvertent rotation would otherwise be limited only by the springs and shocks when the vehicle is lifted off a surface. The trailing arm mounting provides freedom of longitudinal motion of the trailing arm by virtue of the slidable engagement with the collar members. Thus, as the user forcefully positionally adjusts the wheel assembly, the resilient bendability and longitudinally slidable mounting of the trailing arms permit wheel base rotation but prevent unlimited rotation of the wheel base about the adjustment rod axis.

Figure 8:
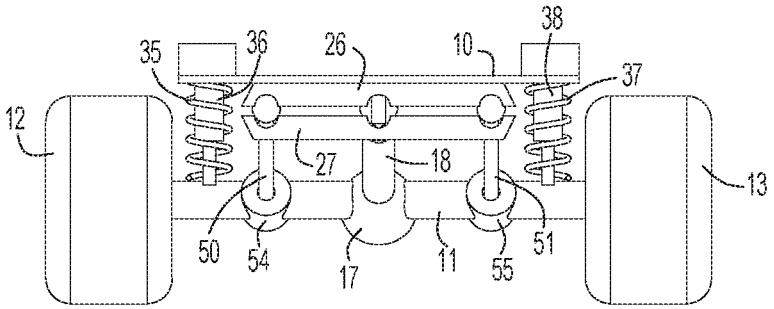
FIG. 8 is a partial view in vertical section of the first embodiment shown in the first operational mode with the springs extended.
Figure 9:
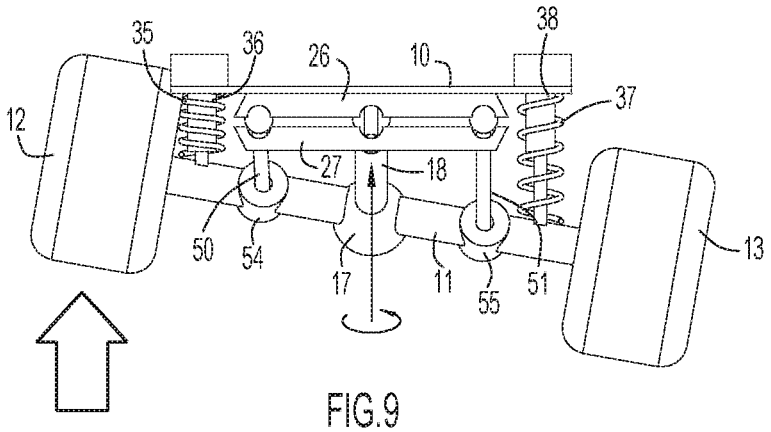
FIG. 9 is a partial view in vertical section of the first embodiment shown in the second operational mode with the wheel assembly diagrammatically shown being placed in a first articulated position.
Figure 10:
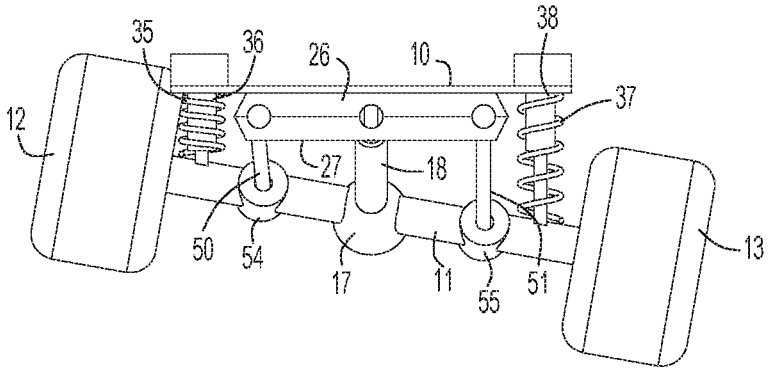
FIG. 10 is a partial view in vertical section of the first embodiment shown in the second operational mode with the wheel assembly shown stably remaining in the first articulated position.

In order to reorient either the front or rear wheel base from the first operation mode shown in FIG. 8, a user would first place the vehicle in the second operational mode by tightening adjustment member 28 to close the transfer case. The user would then move a wheel base, for example the front wheel base, by pushing on either wheel 12 or 13 or grasping one or both wheels and thereby forcefully moving the wheel base axle in opposition to the frictional engagement of the ball member 20 between the cover plate 27 and base plate 26 of the transfer case 25. See, for example, the motion arrow in FIG. 9. One example of a resulting articulated position of the wheel base is illustrated in FIG. 10; another example is illustrated in FIG. 3.

Figure 2:
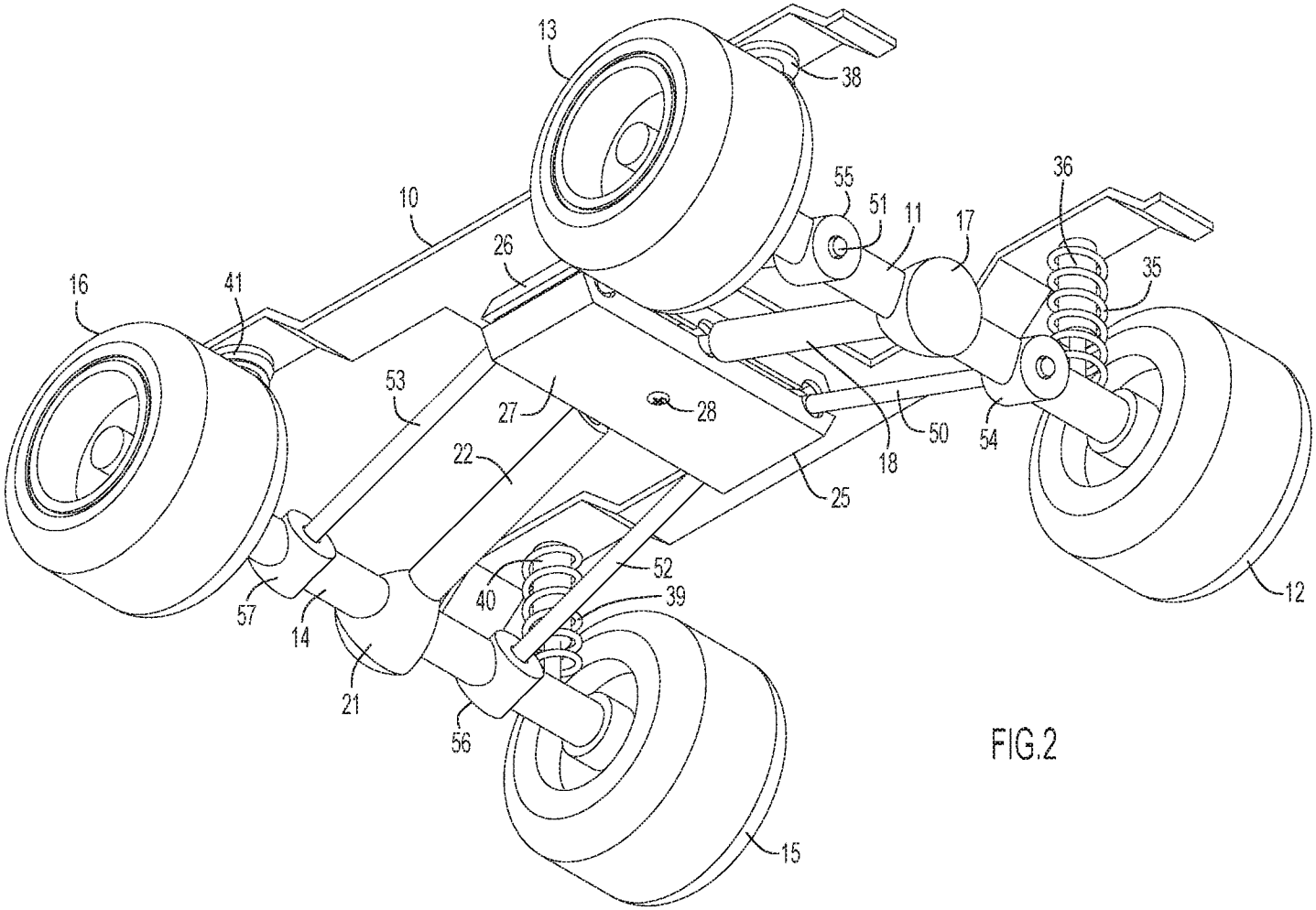
FIG. 2 is a bottom view in perspective of the first embodiment shown in its first operational mode with the suspension system springs uncompressed.
Figure 3:
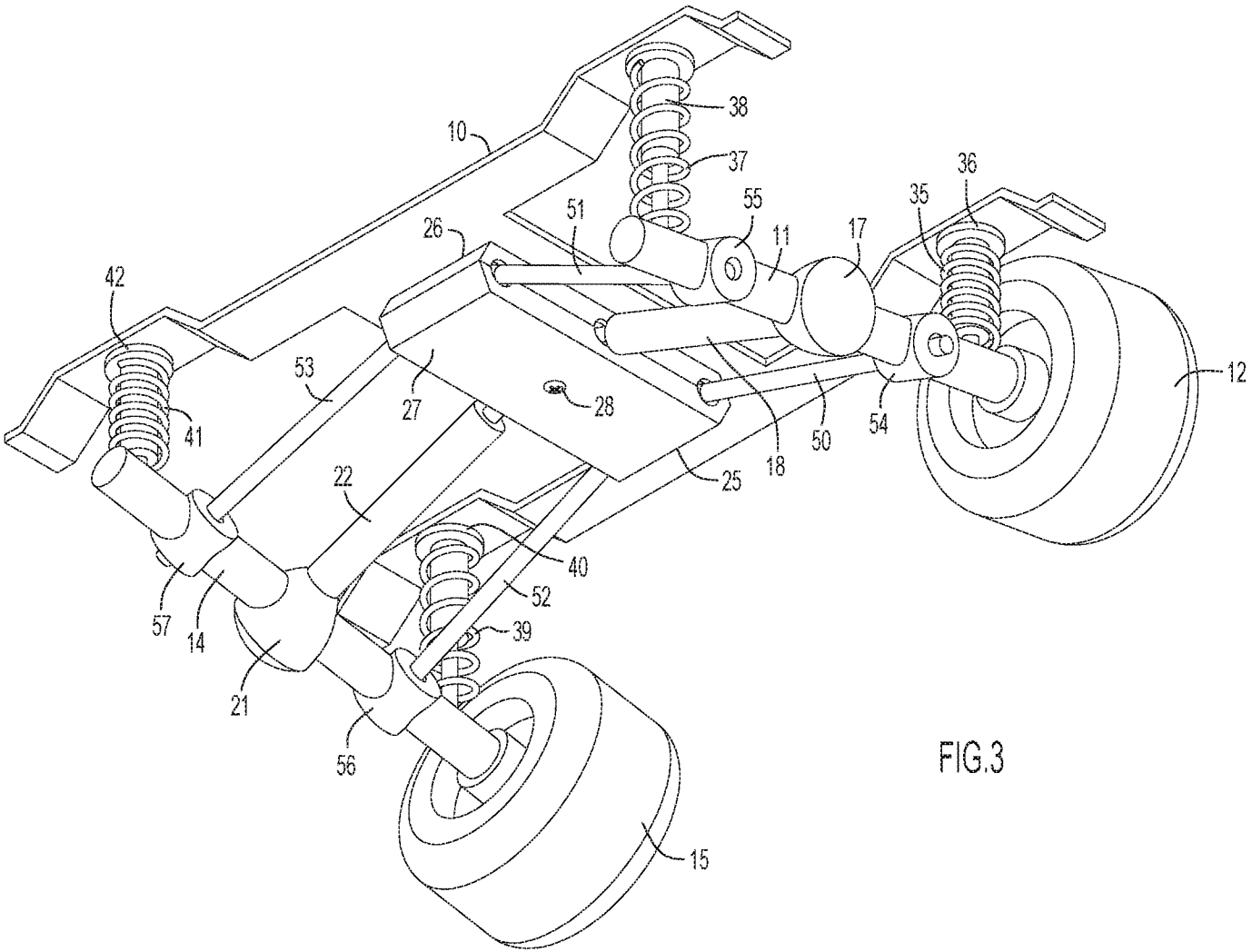
FIG. 3 is a bottom view in perspective the first embodiment shown in its second operational mode and wherein the wheels have been selectively repositioned.
Figure 4:
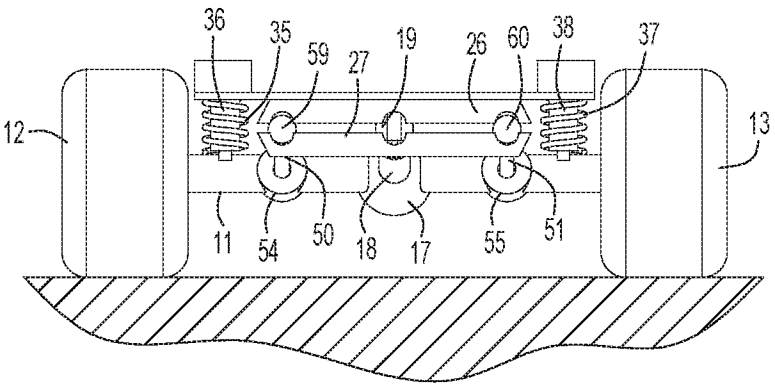
FIG. 4 is a partial view in vertical elevation of the first embodiment as illustrated in FIG. 1 shown with the vehicle wheels on the ground and the springs compressed.
Figure 5:
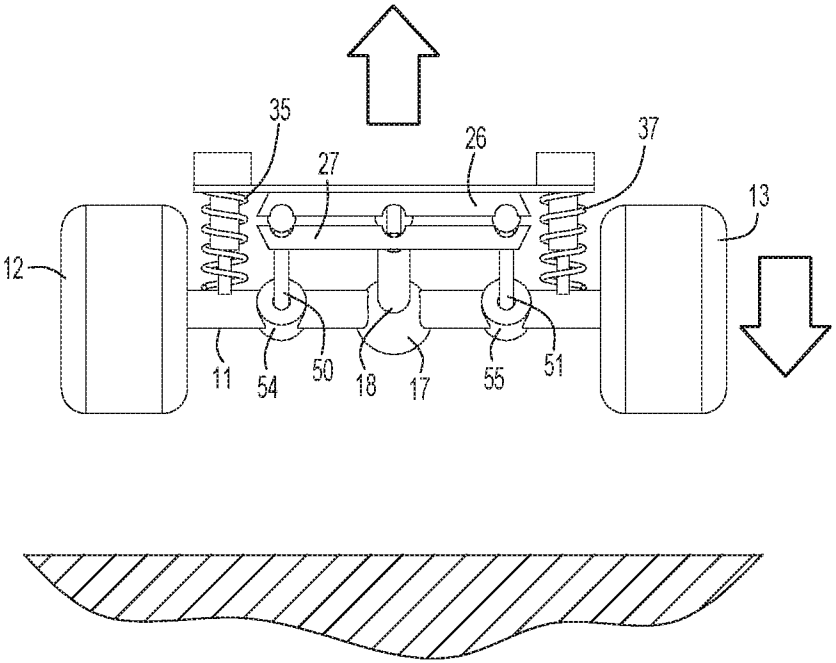
FIG. 5 is a partial view in vertical elevation of the first embodiment as illustrated in FIG. 4 but shown with the vehicle wheels off the ground and the springs uncompressed.
Figure 6:
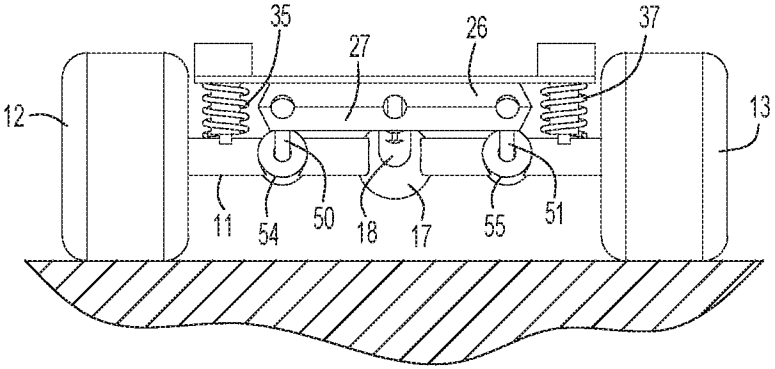
FIG. 6 is a partial view in vertical section of the first embodiment shown in its second operational mode with the vehicle wheels on the ground and the springs compressed.
Figure 7:
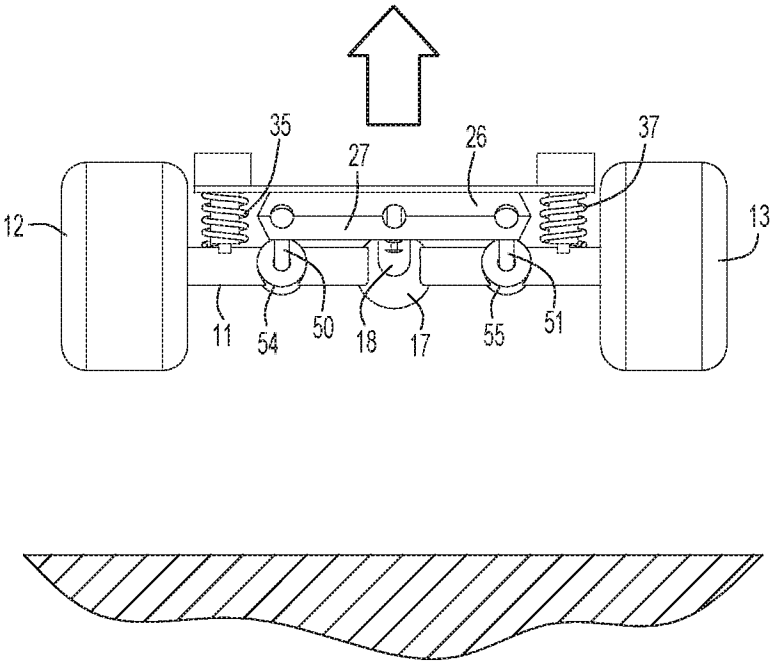
FIG. 7 is a partial view in vertical section of the first embodiment shown in the second operational mode with the vehicle wheels shown off the ground and the springs compressed.

Notably, in the FIG. 3 example, the transfer case 25 is closed, the left front spring 35 is compressed, the right front spring 37 is uncompressed, the left front trailing arm 50 is extended beyond collar member 54 (e.g., as compared to FIG. 2), and right front trailing arm 51 is retracted within collar member 55 (e.g., as compared to FIG. 2). As noted, the frictional engagement of the ball member in the transfer case retains the moved wheel base in the final position in which it is placed. It will be appreciated that each wheel base is movable and repositionable independently of the other. Moreover, the positions of the wheel bases provide different overall appearances of the vehicle and determine the manner in which the vehicle moves when pushed along a surface.

A second embodiment of the invention is illustrated in in FIGS. 14-23, which are similar to FIGS. 1-10, respectively, except that the trailing arms 50, 51, 52 and 53 have been replaced by torsion springs 70, 71. Specifically, left torsion spring 70 is coiled at its center about a stud 72 projecting transversely from the left side of transfer case 25, and the ends of its arms are slidably retained in respective collar members 54 and 56. Right torsion spring 71 is coiled at its center about a stud 73 projecting transversely from the right side of transfer case 25, and the ends of its arms are slidably retained in respective collar members 55 and 57. Thus, as the user forcefully positionally adjusts a wheel assembly in the second operational mode, the resilience of the arms of torsion springs 70, 71 and their longitudinally slidable mounting in their collar members permit some rotation but prevent unlimited rotation of the wheel base about the adjustment rod axis.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Any embodiment described herein is intended to be exemplary and is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments.

Parts List

| Reference Numeral | Part |
|---|---|
| 10 | vehicle chassis |
| 11 | front axle |
| 12 | left front wheel |
| 13 | right front wheel |
| 14 | rear axle |
| 15 | left rear wheel |
| 16 | right rear wheel |
| 17 | front mounting block |
| 18 | front adjustment rod |

-continued

Parts List

| Reference Numeral | Part |
|---|---|
| 19 | front adjustment rod neck |
| 20 | front adjustment rod ball member |
| 21 | rear mounting block |
| 22 | rear adjustment rod |
| 25 | transfer case |
| 26 | transfer case back plate |
| 27 | transfer case cover plate |
| 28 | cover adjustment member |
| 29 | base plate forward recess |
| 30 | cover plate forward recess |
| 31 | base plate rearward recess |
| 32 | cover plate rearward recess |
| 35 | left front compression spring |
| 36 | left front shock absorber |
| 37 | right front compression spring |
| 38 | right front shock absorber |
| 39 | left rear compression spring |
| 40 | left rear shock absorber |
| 41 | right rear compression spring |
| 42 | right rear shock absorber |
| 50 | left front trailing arm |
| 51 | right front trailing arm |
| 52 | left rear trailing arm |
| 53 | right rear trailing arm |
| 54 | left front collar |
| 55 | right front collar |
| 56 | left rear collar |
| 57 | right rear collar |
| 59 | left front ball member |
| 60 | right front ball member |
| 61 | left rear ball member |
| 62 | right rear ball member |
| 70 | left torsion spring |
| 71 | right torsion spring |
| 72 | left side spring support stud |
| 73 | right side spring support stud |

The invention claimed is:

1. A toy vehicle, comprising:

a chassis;

a front wheel base; and a suspension system that adjustably secures the front wheel base to the chassis in a manner that provides two operational modes:

a first mode where the front wheel base is freely, resiliently supported below the chassis; and a second mode where the front wheel base is selectively posable by a user over a range of orientations for different types of vehicle mobility, the suspension system retaining poses when the toy vehicle is operating in the second mode;

wherein the suspension system comprises a transfer case operable to switch the toy vehicle between the first mode and the second mode, the transfer case comprising:

a base plate fixedly coupled to the chassis; and a cover plate that is movably connected to the base plate, wherein the front wheel base is rigidly secured to the transfer case, and wherein tightening a connection between the base plate and the cover plate moves the cover plate towards the base plate and causes the toy vehicle to operate in the second mode, and loosening the connection between the base plate and the cover plate moves the cover plate away from the base plate and causes the toy vehicle to operate in the first mode.

2. The toy vehicle of claim 1, wherein the front wheel base comprises:

a front axle; and two front wheels positioned on opposite ends of the front axle.

3. The toy vehicle of claim 1, further comprising:

a rear wheel base, the rear wheel base including a rear axle that is longitudinally spaced from a front axle included in the front wheel base, wherein the suspension system allows the front axle to move independently from the rear axle.

4. The toy vehicle of claim 3, wherein the suspension system permits the front wheel base to be posed independently from the rear wheel base.

5. The toy vehicle of claim 1, wherein the cover plate is movably connected to the base plate via an adjustment member that can be repeatedly tightened and loosened.

6. The toy vehicle of claim 1, wherein the suspension system comprises:

a normalizing assembly that extends between the front wheel base and the transfer case, the normalizing assembly preventing unlimited and inadvertent rotation of the front wheel base.

7. The toy vehicle of claim 6, wherein the normalizing assembly comprises:

a pair of front trailing arms that connect the front wheel base to the transfer case, the pair of front trailing arms being movable longitudinally with respect to at least one of the front wheel base and the transfer case to permit limited rotation of the front wheel base with respect to the transfer case.

8. The toy vehicle of claim 6, wherein the normalizing assembly comprises:

a plurality of torsion springs, each torsion spring of the plurality of torsion springs having a center coil secured at a side of the transfer case and arms slidably extending through the front wheel base.

9. A toy vehicle, comprising:

a chassis;

a front wheel base; and a suspension system that adjustably secures the front wheel base to the chassis in a manner that provides two operational modes:

a first mode where the front wheel base is freely, resiliently supported below the chassis; and a second mode where the front wheel base is selectively posable by a user over a range of orientations for different types of vehicle mobility, the suspension system retaining poses when the toy vehicle is operating in the second mode;

wherein the suspension system comprises:

a transfer case operable to switch the toy vehicle between the first mode and the second mode; and a front adjustment rod with a proximal end coupled to the front wheel base and a distal end coupled to the transfer case, the distal end of the front adjustment rod terminating in a front ball member disposed in the transfer case, wherein the transfer case is operable to tighten against the front ball member to switch the toy vehicle from the first mode to the second mode.

10. The toy vehicle of claim 9, wherein the suspension system comprises:

one or more front compression springs that connect the front wheel base to the chassis, wherein the one or more front compression springs resiliently support the front wheel base when the front ball member is loosely secured within the transfer case so that the toy vehicle is operating in the first mode.

11. The toy vehicle of claim 10, wherein the front wheel base is rigidly secured to the transfer case proximate a longitudinal center of the front wheel base and the one or more front compression springs connect the front wheel base to the chassis proximate opposite ends of the front wheel base.

12. The toy vehicle of claim 10, wherein the suspension system comprises:

one or more front shock rods, each of the one or more front compression springs concentrically surrounding each of the one or more front shock rods.

13. A toy vehicle suspension system for a toy vehicle comprising:

a transfer case that is coupleable to a chassis of a toy vehicle; and a front adjustment rod comprising a proximal end that is coupleable to a front axle of the toy vehicle and a distal end coupled to the transfer case, the distal end of the front adjustment rod terminating in a front ball member disposed in the transfer case, wherein:

the transfer case is operable to loosen around the front ball member to cause the toy vehicle to operate in a first mode where the front axle is freely, resiliently supported below the chassis; and the transfer case is operable to tighten against the front ball member to cause the toy vehicle to operate in a second mode where the front axle of the toy vehicle is posable by a user over a range of orientations, wherein a tightened connection between the transfer case and the front ball member retains poses when the toy vehicle is operating in the second mode.

14. The toy vehicle suspension system of claim 13, further comprising:

a rear adjustment rod comprising a proximal end that is coupleable to a rear axle of the toy vehicle and a distal end coupled to the transfer case, the distal end of the rear adjustment rod terminating in a rear ball member disposed in the transfer case, wherein:

when the transfer case loosens around the front ball member, the transfer case loosens around the rear ball member to freely, resiliently support the rear axle below the chassis when the toy vehicle is operating in the first mode; and when the transfer case tightens around the front ball member, the transfer case tightens against the rear ball member so that the rear axle is posable by a user over the range of orientations, wherein a tightened connection between the transfer case and the rear ball member retains poses when the toy vehicle is operating in the second mode.

15. The toy vehicle suspension system of claim 14, further comprising:

one or more front compression springs that connect the front axle to the chassis; and one or more rear compression springs that connect the rear axle to the chassis.

16. The toy vehicle suspension system of claim 14, further comprising:

a normalizing assembly that extends between the front axle and the transfer case and between the rear axle and the transfer case, the normalizing assembly comprising:

pairs of trailing arms that connect the front axle and the rear axle to the transfer case, the pairs of trailing arms being movable longitudinally with respect to at least one of the front axle, the rear axle, and the transfer case to permit limited rotation of the front axle and the rear axle with respect to the transfer case; or a plurality of torsion springs, each torsion spring of the plurality of torsion springs having a center coil secured at a side of the transfer case and arms slidably extending through the front axle and the rear axle.

* * * * *